US007014055B2

(12) United States Patent
Kano et al.

(10) Patent No.: US 7,014,055 B2
(45) Date of Patent: Mar. 21, 2006

(54) SYNTHETIC RESIN CONTAINER CLOSURE

(75) Inventors: Yuji Kano, Hiratsuka (JP); Hisashi Nakajima, Hiratsuka (JP)

(73) Assignee: Japan Crown Cork Co., Ltd., Tokyo (JP)

( * ) Notice: Subject to any disclaimer, the term of this patent is extended or adjusted under 35 U.S.C. 154(b) by 0 days.

(21) Appl. No.: 10/664,869

(22) Filed: Sep. 22, 2003

(65) Prior Publication Data

US 2004/0060893 A1 Apr. 1, 2004

Related U.S. Application Data

(62) Division of application No. 09/804,267, filed on Mar. 13, 2001, now Pat. No. 6,779,672.

(30) Foreign Application Priority Data

Mar. 13, 2000 (JP) ..... 2000-68690
Sep. 29, 2000 (JP) ..... 2000-298619

(51) Int. Cl.
*B65D 53/00* (2006.01)

(52) U.S. Cl. ..... 215/344; 215/252; 215/341; 215/DIG. 1

(58) Field of Classification Search ..... 215/341, 215/344, 345, 354, DIG. 1, 252
See application file for complete search history.

(56) References Cited

U.S. PATENT DOCUMENTS 3,463,340 A 8/1969 Lindstrom
4,489,845 A 12/1984 Aichinger et al.
4,560,077 A 12/1985 Dutt
4,566,603 A * 1/1986 Moore ..... 215/344
5,297,688 A 3/1994 Beck et al.
5,307,945 A 5/1994 Hidding et al.
5,871,111 A 2/1999 Pfefferkorn et al.
6,003,701 A 12/1999 Hidding et al.
6,021,912 A 2/2000 Hertrampf
6,260,722 B1 * 7/2001 Ekkert ..... 215/341
6,325,226 B1 12/2001 Krautkramer
6,338,414 B1 1/2002 Schellenbach

FOREIGN PATENT DOCUMENTS

JP 10-35699 2/1998

* cited by examiner

*Primary Examiner*—Robin A. Hylton

(74) *Attorney, Agent, or Firm*—McGinn IP Law Group, PLLC

(57) ABSTRACT

A container closure formed from a synthetic resin as a single unit has a circular top panel wall and a cylindrical skirt wall extending downwardly from the peripheral edge of the top panel wall. An outer cylindrical sealing protrusion, an inner cylindrical sealing protrusion, and annular sealing ridge, all having a predetermined shape and a predetermined size, are formed on the inner surface of the top panel wall. In one embodiment, the thickness of the center portion of the top panel wall is reduced to a predetermined range and a plurality of ribs having a predetermined thickness are formed on the inner surface of the center portion of the top panel wall.

5 Claims, 5 Drawing Sheets

SYNTHETIC RESIN CONTAINER CLOSURE

CROSS REFERENCE TO RELATED APPLICATIONS

This application is a divisional application of Ser. No. 09/804,267 filed Mar. 13, 2001, now U.S. Pat. No. 6,779,672.

FIELD OF THE INVENTION

The present invention relates to a synthetic resin container closure formed from a synthetic resin material as a single unit and, more specifically, to a synthetic resin container closure which has a circular top panel wall and a cylindrical skirt wall extending downwardly from the peripheral edge of this top panel wall, one or two cylindrical sealing protrusions that extend downwardly being formed on the inner surface of the top panel wall.

DESCRIPTION OF THE PRIOR ART

A synthetic resin container closure which is wholly formed from an appropriate synthetic resin such as polypropylene or polyethylene as a single unit has been proposed as a container closure for drink or beverage containers and has been put to practical use. The container closure has a circular top panel wall and a cylindrical skirt wall extending downwardly from the peripheral edge of this top panel wall, and one or two cylindrical sealing protrusions extending downwardly are formed on the inner surface of the top panel wall. In a container closure disclosed in FIG. 3 of Japanese Unexamined Laid-Open Patent Publication 10-35699, two cylindrical protrusions, that is, an outer cylindrical protrusion and an inner cylindrical sealing protrusion both extending downwardly, are formed on the inner surface of the top panel wall. On the inner surface of the top panel wall is further formed an annular sealing ridge adjacent to the base portion of the outer cylindrical protrusion. The trade name of a product, the name of a manufacturer or distributor and the like are printed on the outer surface of the top panel wall by offset printing, for example. A female thread is formed on the inner peripheral surface of the skirt wall. This container closure is mounted on a container having a male thread formed on the outer peripheral surface of a mouth-neck portion. When the female thread of the container closure is screwed onto the male thread of the mouth-neck portion to mount the container closure on the mouth-neck portion, the inner cylindrical sealing protrusion is brought into close contact with the inner peripheral surface of the mouth-neck portion, and the annular sealing ridge is also brought into close contact with the boundary region between the outer peripheral surface and the top surface of the mouth-neck portion. The outer cylindrical protrusion is brought into not close contact, but relatively loose contact with the outer peripheral surface of the mouth-neck portion to assist close contact of the annular sealing ridge with the boundary region between the outer peripheral surface and the top surface of the mouth-neck portion.

However, the above container closure of the prior art involves the following problems to be solved. Firstly, in the above container closure of the prior art, it is necessary to fully and surely satisfy the basic requirement that when the container closure is mounted on the mouth-neck portion of the container, the mouth-neck portion is sealed hermetically without fail and when the mouth-neck portion is to be opened, appropriate torque is applied to the container closure to turn the container closure, without requiring excessive torque, so that the container closure can be removed from the mouth-neck portion. In addition, it is important that when the mouth-neck portion is to be opened, the sealing of the mouth-neck portion should be released after the container closure is turned at an angle larger than the required rotation angle. Describing this point in more detail, a weakening line is generally formed in the skirt wall of the container closure such that it extends in a circumferential direction, the skirt wall is divided into a main portion above the weakening line and a tamper-evident skirt portion below the weakening line, the above female thread is formed on the inner peripheral surface of the main portion, and an engaging means having an appropriate shape is formed on the inner peripheral surface of the tamper-evident skirt portion. When the container closure is mounted on the mouth-neck portion of the container, the engaging means is engaged with an engaging jaw portion formed on the outer peripheral surface of the mouth-neck portion. When the container closure is turned in an opening direction to open the mouth-neck portion of the container, the weakening line is at least partially broken, whereby the engagement of the engaging means with the engaging jaw portion is released, and the container closure is allowed to be removed from the mouth-neck portion. It is important that when the container closure is turned in the opening direction, the sealing of the mouth-neck portion should be released after the weakening line is at least partially broken. If the sealing of the mouth-neck portion is released before the weakening line is at least partially broken, there occurs such a situation that though the container closure has been tampered to be turned in the opening direction and the sealing of the mouth-neck portion has been released, the weakening line is not broken, and accordingly an indication that the container closure has been tampered and the sealing of the mouth-neck portion has been released does not remain. Therefore, in the above container closure of the prior art, there is a tendency that the sealing of the mouth-neck portion is released before the container closure is turned at a predetermined rotation angle owing to the production tolerance of the container closure and/or the mouth-neck portion or owing to the thermal deformation of the container closure and/or the mouth-neck portion, and there may occur a case where the above basic requirement can not be satisfied.

Secondly, the above container closure is formed from an appropriate synthetic resin by compression molding or injection molding. The molding efficiency of the molding step greatly depends on the required cooling time in the mold, as is well known to people having ordinary skill in the art. When the molded container closure is removed from the mold before the passage of the required cooling time, deformation greater than the permissible range may occur in the circular top panel wall. More specifically, there is a tendency for the center of the top panel wall to be indented, and consequently the top panel wall has a depressed shape more than the permissible range. To shorten the required cooling time without causing deformation greater than the permissible range in the top panel wall, it is known for the thickness of the top panel wall, particularly the center portion positioned on the inner side of the inner cylindrical sealing protrusion, to be reduced to promote the cooling of the top panel wall, particularly the center portion thereof. However, when the thickness of the top panel wall, particularly the center portion thereof, is reduced, another problem arises as follows. When the outer surface of the top panel wall is to be printed, the container closure is mounted on a mandrel to contact the top surface of the mandrel to the inner surface of the center portion of the top panel wall, and then an offset printing roller made from a material having elasticity, such as synthetic rubber, is applied to the outer surface of the top panel wall of the container closure in a printing area. Even when the outer surface of the top panel wall has some distortion of ordinary permissible degree, it is important for carrying out fully satisfactory printing that the printing roller should be compressed by approximately 1 mm when the printing roller is applied to the outer surface of the top panel wall of the container closure. In this case, when the thickness of the top panel wall is reduced to 1 mm for example, the space between the peripheral surface of the printing roller and the top surface of the mandrel to which the container closure is not mounted must be set to substantially zero. In a case of the setting being made like this, if the mandrel is moved through the printing area without the container closure mounted thereon for some accidental reason, printing ink will be adhered to the top surface of the mandrel, and the inner surface of the center portion of the top panel wall of the container closure will be stained by the printing ink when the container closure is then mounted on this mandrel. When the space between the top surface of the mandrel and the peripheral surface of the printing roller is made large to prevent this situation, the amount of compression of the printing roller at the time when the printing roller is applied to the outer surface of the top panel wall of the container closure mounted on the mandrel becomes too small, thereby making it impossible to carry out satisfactory printing in a case where the outer surface of the top panel wall has some general permissible distortion. Further, if the thickness of the top panel wall, particularly the center portion, is reduced, the rigidity of the top panel wall is inevitably reduced, whereby the so-called flexibility of the inner cylindrical sealing protrusion becomes too large, contact pressure between the inner cylindrical sealing protrusion and the inner peripheral surface of the mouth-neck portion of the container becomes too small, and hence the hermetical sealing of the mouth-neck portion is liable to be insufficient.

SUMMARY OF THE INVENTION

It is therefore the first object of the present invention to provide a novel and improved synthetic resin container closure which can seal hermetically the mouth-neck portion of a container fully reliably when it is mounted on the mouth-neck portion of the container, can be removed from the mouth-neck portion by applying appropriate torque to turn it without requiring excessive torque, so as to open the mouth-neck portion, and simultaneously can release the hermetical sealing of the mouth-neck portion after turning it at an angle larger than the required rotation angle to open the mouth-neck portion.

It is the second object of the present invention to provide a novel and improved synthetic resin container closure which does not cause any inconvenience in the printing step and does not cause unsatisfactory sealing of the mouth-neck portion of a container even though the cooling time required for compression molding or injection molding can be considerably reduced.

According to the first aspect of the present invention, there is provided a container closure which has a circular top panel wall and a cylindrical skirt wall extending downwardly from the peripheral edge of the top panel wall and which is formed from a synthetic resin as a single unit, wherein an outer cylindrical sealing protrusion extending downwardly, an inner cylindrical sealing protrusion extending downwardly and an annular sealing ridge located between the outer cylindrical sealing protrusion and the inner cylindrical sealing protrusion and projecting downwardly are formed on the inner surface of the top panel wall;

when the container closure is mounted on the mouth-neck portion of a container, the inner peripheral surface of the outer cylindrical sealing protrusion is brought into close contact with the outer peripheral surface of the mouth-neck portion, the outer peripheral surface of the inner cylindrical sealing protrusion is brought into close contact with the inner peripheral surface of the mouth-neck portion, and the annular sealing ridge is brought into close contact with the top surface of the mouth-neck portion; and in a state before the container closure is mounted on the mouth-neck portion of the container, the minimum internal diameter D1 of a portion, that is to be brought into close contact with the outer peripheral surface of the mouth-neck portion, of the inner peripheral surface of the outer cylindrical sealing protrusion is smaller than the external diameter D2 of the outer peripheral surface, that is to be brought into close contact, of the mouth-neck portion and satisfies $0.05\ \text{mm} \leqq (D2-D1) \leqq 0.60\ \text{mm}$, and the maximum external diameter D3 of a portion, that is to be brought into close contact with the mouth-neck portion, of the outer peripheral surface of the inner cylindrical sealing protrusion is larger than the internal diameter D4 of the inner peripheral surface, that is to be brought into close contact, of the mouth-neck portion and satisfies $0.25\ \text{mm} \leqq (D3-D4) \leqq 1.50\ \text{mm}$.

The container closure provided according to the first aspect of the present invention can be advantageously used when a container formed from an appropriate synthetic resin such as polyethylene terephthalate (the present invention is not limited to this) is filled with contents heated at approximately 80 to 95° C. (so-called hot packing). As is well known to people having ordinary skill in the art, after the synthetic resin container to be filled with contents heated at approximately 80 to 95° C. is molded into a predetermined shape, the mouth-neck portion thereof is crystallized by heating, thereby slightly reducing the dimensional accuracy of the mouth-neck portion.

Preferably, the outer peripheral surface of the inner cylindrical sealing protrusion extends downwardly in such a manner that it is inclined outward in a radial direction at an inclination angle $\theta 1$ with respect to the center axis of the container closure and then, extends downwardly in such a manner that it is inclined inward in a radial direction at an inclination angle $\theta 2$ with respect to the center axis. The inclination angle $\theta 1$ may be 5 to 25° and the inclination angle $\theta 2$ may be 5 to 30°. The inner peripheral surface of the inner cylindrical sealing protrusion extends downwardly in such a manner that it is inclined outward in a radial direction at an inclination angle $\theta 3$ with respect to the center axis, and then, extends substantially parallel with the center axis. Preferably, the outer peripheral surface of the inner cylindrical sealing protrusion has the maximum external diametetr D3 at a position below, and away from, the inner surface of the top panel wall by a length L1 of 2.50 to 3.50 mm. In a preferred embodiment, the inclination angle $\theta 3$ of the inner peripheral surface of the inner cylindrical sealing protrusion is larger than the inclination angle $\theta 1$ of the outer peripheral surface of the inner cylindrical sealing protrusion at a position above the portion having the maximum external diameter D3. The inner peripheral surface of the outer cylindrical sealing protrusion extends downwardly in such a manner that it is inclined inward in a radial direction at an inclination angle θ4 with respect to the center axis, and then, extends downward in such a manner that it is inclined outward in a radial direction. The inclination angle θ4 may be 13 to 23°. The outer peripheral surface of the outer cylindrical sealing protrusion extends downwardly in such a manner that it is inclined inward in a radial direction at an inclination angle θ5 with respect to the center axis. The inclination angle θ5 is larger than the inclination angle θ4 and may be 15 to 25°. Preferably, the inner peripheral surface of the outer cylindrical sealing protrusion has the minimum internal diameter D1 at a position below, and away from, the inner surface of the top panel wall by a length L2 of 0.60 to 1.50 mm.

If (D2−D1) and (D3−D4) are too small, a tendency occurs that the hermetical sealing of the mouth-neck portion may become unsatisfactory, and at the same time the sealing of the mouth-neck portion may be released before the container closure is turned at a required rotation angle to open the mouth-neck portion. On the other hand, if (D2−D1) and (D3−D4) are too large, there is a tendency that torque to be applied to the container closure to open the mouth-neck portion may become excessive.

According to a second aspect of the present invention, to attain the second object of the present invention, there is provided a container closure which has a circular top panel wall and a cylindrical skirt wall extending downwardly from the peripheral edge of the top panel wall, a cylindrical sealing protrusion extending downwardly to be brought into close contact with the inner peripheral surface of the mouth-neck portion of a container being formed on the inner surface of the top panel wall, and which is formed from a synthetic resin as a single unit, wherein a plurality of ribs are formed on the inner surface of a center portion located on the inner side of the cylindrical sealing protrusion of the top panel wall, the thickness T1 of the center portion of the top panel wall is 0.80 to 1.20 mm, the thickness T2 of each of the ribs is 0.20 to 1.00 mm, and the total (T1+T2) of the thickness T1 and the thickness T2 is 1.20 to 1.80 mm.

Preferably, the thickness T1 is 0.90 to 1.10 mm, the thickness T2 is 0.30 to 0.50, and the total (T1+T2) of the thickness T1 and the thickness T2 is 1.30 to 1.50 mm. In a preferred embodiment, the ribs extend radially. The ribs are arranged at equiangular intervals and extend continuously from the center of the center portion to the peripheral edge of the top panel wall. The ribs have a rectangular cross sectional form, and when in a bottom view the area of the center portion of the top panel wall is represented by S1 and the total area of the ribs is represented by S2, S1 and S2 satisfy $0.10S1<S2<0.40S1$, preferably $0.15S1<S2<0.35S1$.

If the thickness T1 of the center portion of the top panel wall is too large, the thickness T2 of each of the ribs is too large, or the total of the thickness T1 of the center portion of the top panel wall and the thickness T2 of each of the ribs is too large, the cooling time required for preventing deformation larger than the permissible range in the top panel wall will become long. If the thickness T1 of the center portion of the top panel wall is too small, the rigidity of the top panel wall will become too low and the hermetical sealing of the mouth-neck portion of the container will become insufficient. If the thickness T2 of each of the ribs is too small or the total of the thickness T1 of the center portion of the top panel wall and the thickness T2 of each of the ribs is too small, the rigidity of the top panel wall will become too low and at the same time, it becomes necessary to set the space between the top surface of a mandrel and the peripheral surface of a printing roller to an extremely small value in the printing step, and there is a possibility that the inner surface of the center portion of the top panel wall is stained by a printing ink as described above.

Further, according to a third aspect of the present invention, to attain the first object of the present invention, there is provided a container closure which has a circular top panel wall and a cylindrical skirt wall extending downwardly from the peripheral edge of the top panel wall and which is formed from a synthetic resin as a single unit, wherein an outer cylindrical sealing protrusion extending downwardly, an inner cylindrical sealing protrusion extending downwardly and an annular sealing ridge which is located between the outer cylindrical sealing protrusion and the inner cylindrical sealing protrusion and projects downwardly are formed on the inner surface of the top panel wall;

when the container closure is mounted on the mouth-neck portion of a container, the inner peripheral surface of the outer cylindrical sealing protrusion is brought into close contact with the outer peripheral surface of the mouth-neck portion, the outer peripheral surface of the inner cylindrical sealing protrusion is brought into close contact with the inner peripheral surface of the mouth-neck portion, and the annular sealing ridge is brought into close contact with the top surface of the mouth-neck portion;

in a state before the container closure is mounted on the mouth-neck portion of the container, the maximum external diameter D3 of a portion to be brought into close contact with the inner peripheral surface of the mouth-neck portion, of the outer peripheral surface of the inner cylindrical sealing protrusion is larger than the internal diameter D4 of the inner peripheral surface to be brought into close contact, of the mouth-neck portion and satisfies $0.25\ \text{mm} \leqq (D3-D4) \leqq 1.50\ \text{mm}$; and the inner peripheral surface of the outer cylindrical sealing protrusion extends downwardly in such a manner that it is inclined outward in a radial direction at an inclination angle θ6 with respect to the center axis, and then, extends downwardly and radially outwardly in an arc form.

The container closure provided according to the third aspect of the present invention can be advantageously used when a container formed from an appropriate synthetic resin such as polyethylene terephthalate is filled with contents having a normal temperature in a germ-free or germ reduced state (so-called aseptic filling). As is well known to people having ordinary skill in the art, the synthetic resin container filled with contents having a normal temperature has a mouth-neck portion with fairly high dimensional accuracy because the mouth-neck portion is not crystallized by heating.

Preferably, the outer peripheral surface of the outer cylindrical sealing protrusion extends substantially parallel with the center axis. Preferably, the outer peripheral surface of the inner cylindrical sealing protrusion extends downwardly in such a manner that it is inclined outward in a radial direction at an inclination angle θ1 with respect to the center axis of the container closure and then, extends downwardly in such a manner that it is inclined inward in a radial direction at an inclination angle θ2 with respect to the center axis. The inclination angle θ1 may be 5 to 25°. Preferably, the inner peripheral surface of the inner cylindrical sealing protrusion extends downwardly in such a manner that it is inclined outward in a radial direction at an inclination angle θ3 with respect to the center axis and then, extends substantially parallel with the center axis. Preferably, the outer peripheral surface of the inner cylindrical sealing protrusion has the maximum external diameter D3 at a position below, and away from, the inner surface of the top panel wall by a length L1 of 2.50 to 3.50 mm. In a preferred embodiment, the inclination angle θ3 of the inner peripheral surface of the inner cylindrical sealing protrusion is larger than the inclination angle θ1 of the outer peripheral surface of the inner cylindrical sealing protrusion at a position above the portion having the maximum external diameter D3.

If (D3–D4) is too small, a tendency occurs that the hermetical sealing of the mouth-neck portion may become unsatisfactory and at the same time, the hermetical sealing of the mouth-neck portion may be released before the container closure is turned at a required rotation angle to open the mouth-neck portion. On the other hand, if (D3–D4) is too large, there is a tendency that torque to be applied to the container closure to open the mouth-neck portion may become excessive. The inner peripheral surface of the outer cylindrical sealing protrusion extends downwardly in such a manner that it is inclined outward in a radial direction at an inclination angle θ6 with respect to the center axis and then, extends downwardly and radially outwardly in an arc form, whereby the container closure can be mounted on the mouth-neck portion sufficiently and easily and there is virtually no possibility that the container closure is mounted improperly.

DETAILED DESCRIPTION OF THE PREFERRED EMBODIMENTS

A synthetic resin container closure constituted according to preferred embodiments of the present invention will be described in further detail with reference to the accompanying drawings hereinafter.

Figure 1:
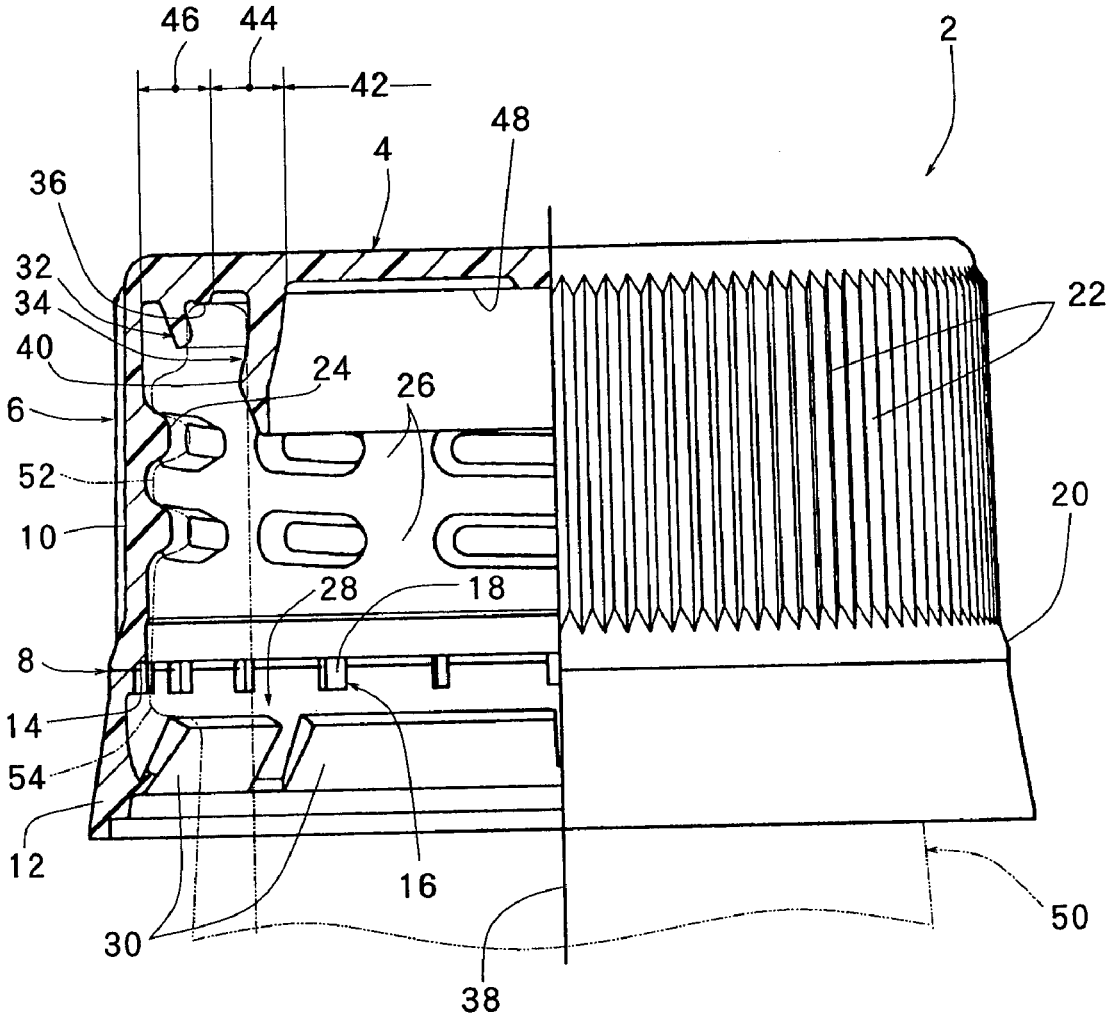
FIG. 1 is partially a side view and partially a sectional view of a container closure constituted according to a preferred embodiment of the present invention.

Describing with reference to FIG. 1, a container closure constituted according to the present invention and entirely denoted by a numeral 2 can be suitably used in a so-called hot packing system in which contents are heated at 80 to 95° C. and filled into a container, and is formed, as a single unit, from an appropriate synthetic resin such as polypropylene or polyethylene. The container closure 2 has a circular top panel wall 4 and a cylindrical skirt wall 6 extending downwardly from the peripheral edge of the top panel wall 4. A breakable line 8 extending circumferentially is formed in the skirt wall 6 to divide the skirt wall 6 into a main portion 10 above the breakable line 8 and a tamper-evident skirt portion 12 below the breakable line 8. An annular shoulder portion 14 facing downward is formed on the inner peripheral surface of the skirt wall 6, and a plurality of ribs 16 extending downwardly from the annular shoulder portion 14 are formed at appropriate intervals in a circumferential direction. The above breakable line 8 is formed by applying a cutting blade (not shown) to an intermediate portion in an axial direction of each of the ribs 16 from the outer peripheral surface of the skirt wall 6 and cutting the skirt wall 6 with at least part of each of the ribs 16 left behind. A portion left uncut of the rib 16 constitutes a so-called bridging portion 18 and the tamper-evident skirt portion 12 is connected to the main portion 10 of the skirt wall 6 by the bridging portion 18.

A truncated conical portion 20 which has an external diameter gradually increasing downward is formed near the lower end of the outer peripheral surface of the main portion 10 of the skirt wall 6. The outer peripheral surface of the tamper-evident skirt portion 12 is also formed in a truncated conical shape whose external diameter gradually increases downward. On a portion above the truncated conical portion 20 of the outer peripheral surface of the main portion 14 are formed knurls 22 for preventing the slippage of the fingers placed thereon. A female thread 24 is formed on the inner peripheral surface of the main portion 10 of the skirt wall 6. In the female thread 24 are formed axially extending notches 26 at appropriate intervals in the circumferential direction. The above notches 26 constitute a so-call air passage when the mouth-neck portion of the container is opened.

On the inner peripheral surface of the tamper-evident skirt portion 12 is formed an engaging means 28. The engaging means 28 in the illustrated embodiment is composed of a plurality of, for example, 8 flap pieces 30 arranged at appropriate spaces in a circumferential direction. Each of the flap pieces 30 is projected inward in a radial direction from the base edge connected to the inner peripheral surface of the tamper-evident skirt portion 12 in such a manner that it is inclined upward. If desired, the engaging means may be composed of flap pieces having another appropriate shape, ribs, protrusions or the like.

Figure 2:
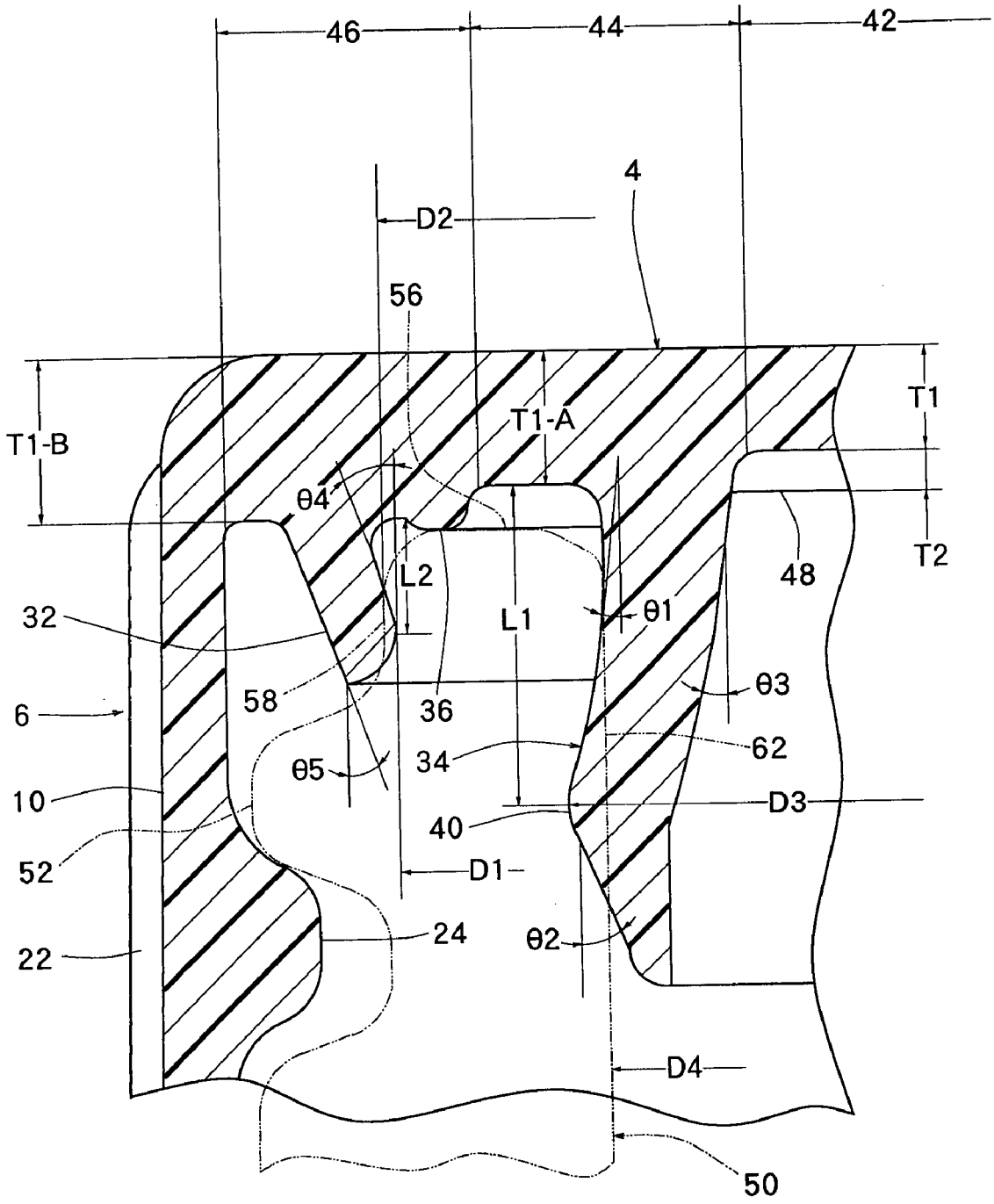
FIG. 2 is a sectional view, on an enlarged scale, of a part of the container closure of FIG. 1.

With reference to FIG. 2 together with FIG. 1, in the container closure constituted according to one aspect of the present invention, it is important that an outer cylindrical sealing protrusion 32, inner cylindrical sealing protrusion 34 and an annular sealing ridge 36 arranged between the outer cylindrical sealing protrusion 32 and the inner cylindrical sealing protrusion 34 should be formed on the inner surface of the top panel wall 4. As is clearly understood from FIG. 2, in the illustrated embodiment, the top panel wall 4 has a relatively small thickness T1 at a center portion which is located on the inner side of the inner cylindrical sealing protrusion 34, a thickness T1-A slightly larger than T1 at a portion between the inner cylindrical sealing protrusion 34 and the annular sealing ridge 36, and a thickness T1-B slightly larger than T1-A at a portion which is located on the outer side of the annular sealing ridge 36 (the thickness of the top panel wall 2 will be further detailed later on).

For the convenience of explanation, the inner cylindrical sealing protrusion 34 will be first described in detail before explanation of the outer cylindrical sealing protrusion 32. The inner cylindrical sealing protrusion 34 in the illustrated embodiment extends downwardly from the inner surface of the top panel wall 4 and its outer peripheral surface extends downwardly in a such a manner that it is inclined outward (left direction in FIG. 2) in a radial direction at an inclination angle θ1 with respect to the center axis 38 (FIG. 1) of the container closure 2 and then, extends downwardly in such a manner that it is inclined inward (right direction in FIG. 2) in a radial direction at an inclination angle θ2 with respect to the above center axis 38. Therefore, a bent portion 40 where the inclination direction is changed is existent on the outer peripheral surface of the inner cylindrical sealing protrusion 34. The above inclination angle θ1 is suitably approximately 5 to 25° and the above inclination angle θ2 is suitably approximately 5 to 30°. In the section view shown in FIG. 2, a portion above the bent portion 40 of the outer peripheral surface of the inner cylindrical sealing protrusion 34 may be a combination of a linear portion and a concave portion having a relatively large curvature radius (the inclination angle θ1 of the concave portion is formed by a tangent at each site and the above center axis 38) or entirely a concave portion, and the bent portion 40 is convex with a relatively small curvature radius. In the section view shown in FIG. 2, the main portion below the bent portion 40 of the outer peripheral surface of the inner cylindrical sealing protrusion 34 extends substantially linearly and a lower end portion extends substantially in an arc form. Since the outer peripheral surface of the inner cylindrical sealing protrusion 34 is shaped as described above, it has the maximum external diameter D3 at the bent portion 40. As will become clear from a description to be given later, the bent portion 40 of the inner cylindrical sealing protrusion 34 is brought into close contact with the inner peripheral surface of the mouth-neck portion of the container, and the above external diameter D3 is therefore the maximum external diameter of the portion to be brought into close contact with the mouth-neck portion, of the container of the inner cylindrical sealing protrusion 34. The portion having the maximum external diameter D3 is suitably located below, and away from, the inner surface of the top panel wall 4 by a length L1 of 2.50 to 3.50 mm.

The inner peripheral surface of the inner cylindrical sealing protrusion 34 extends downwardly in a such a manner that it is inclined outward in a radial direction at an inclination angle θ3 with respect to the above center axis 38 and then extends substantially parallel with the above center axis 38. From the viewpoint of the ease of taking out of a mold after molding, the above inclination angle θ3 of a portion above the bent portion 40 is advantageously larger than the above inclination angle θ1 and may be approximately 7 to 30°. Since the outer peripheral surface and inner peripheral surface of the inner cylindrical sealing protrusion 34 are formed as described above, as will be clearly understood with reference to FIG. 2, the thickness of the inner cylindrical sealing protrusion 34 is gradually decreased downward.

The outer cylindrical sealing protrusion 32 in the illustrated embodiment extends also downwardly from the inner surface of the top panel wall 4. The length of extension of the outer cylindrical sealing protrusion 32 is smaller than the length of extension of the inner cylindrical sealing protrusion 34 and nearly ⅓ the length of extension of the inner cylindrical sealing protrusion 34. The inner peripheral surface of the outer cylindrical sealing protrusion 32 extends downwardly in such a manner that it is inclined inward in a radial direction at an inclination angle θ4 with respect to the above center axis 38 and then, extends downwardly in such a manner that it is inclined outward in a radial direction. The above inclination angle θ4 may be approximately 13 to 23°. A portion extending downwardly in such a manner that it is inclined inward in a radial direction of the inner peripheral surface of the outer cylindrical sealing protrusion 32 is linear, and a portion extending downwardly in such a manner that it is inclined outward in a radial direction is nearly arc-shaped. The inner peripheral surface of the outer cylindrical sealing protrusion 32 has the minimum internal diameter D1 at a portion where its inclination direction is changed, that is, at the boundary between the linear portion and the nearly arc-shaped portion. As will become clear from a description to be given later, the portion where the inclination direction is changed of the inner peripheral surface of the outer cylindrical sealing protrusion 32 is brought into close contact with the outer peripheral surface of the mouth-neck portion of the container, and the minimum internal diameter D1 is therefore the minimum internal diameter of the portion to be brought into close contact with the mouth-neck portion of the container, of the outer cylindrical sealing protrusion 32. The portion having the minimum internal diameter D1 is suitably located below, and away from, the inner surface of the top panel wall 4 by a length L2 of 0.60 to 1.50 mm.

The outer peripheral surface of the outer cylindrical sealing protrusion 32 extends downwardly linearly in such a manner that it is inclined inward in a radial direction at an inclination angle θ5 with respect to the above center axis 38. The inclination angle θ5 is slightly larger than the above inclination angle θ4 and is 15 to 25°. The thickness of the outer cylindrical sealing protrusion 32 is, therefore, gradually decreased downward favorably.

The annular sealing ridge 36 arranged adjacent to the base portion of the outer cylindrical sealing protrusion 32 has a nearly semicircular cross section. The amount of projection of the annular sealing ridge 36 is much smaller than the length of extension of the inner cylindrical sealing protrusion 34 and the length of extension of the outer cylindrical sealing protrusion 32, and the inner cylindrical sealing protrusion 34 and the outer cylindrical sealing protrusion 32 have relatively high flexibility to allow them to be bent inward and outward in a radial direction while the annular sealing ridge 36 has substantially no flexibility.

According to another aspect of the present invention, it is important that the thickness of the top panel wall 4, particularly the thickness of the center portion 42 located on the inner side of the inner cylindrical sealing protrusion 34, should be made fully small in order to shorten the required cooling time in the mold at the time of forming the container closure by compression molding or injection molding, that is, the duration from the time when a fluidized synthetic resin is poured into a desired shape in the mold to the time when the mold is opened and removal of the molded container closure is started. In the illustrated embodiment, the center portion 42 of the top panel wall 4 has a thickness T1, an intermediate portion 44 between the inner cylindrical sealing protrusion 34 and the annular sealing ridge 36 of the top panel wall 4 has a thickness T1-A, a peripheral portion 46 located on the outer side of the annular sealing ridge 36 has a thickness T1-B, and the thickness must satisfy T1<T1-A<T1-B. It is important that the thickness T1 of the center portion 42 should be 0.80 to 1.20 mm, preferably 0.90 to 1.10 mm. If the thickness T1 of the center portion 42 is too large, the required cooling time in the mold will become long and the molding efficiency will lower. If the thickness T1 of the center portion 42 is too small, the rigidity of the top panel wall 44 may become too low and the hermetical sealing of the mouth-neck portion of the container may become insufficient. The thickness T1-A of the intermediate portion 44 may be approximately 1.10 to 1.50 mm and the thickness T1-B of the peripheral portion 46 may be approximately 1.40 to 1.80 mm.

Figure 3:
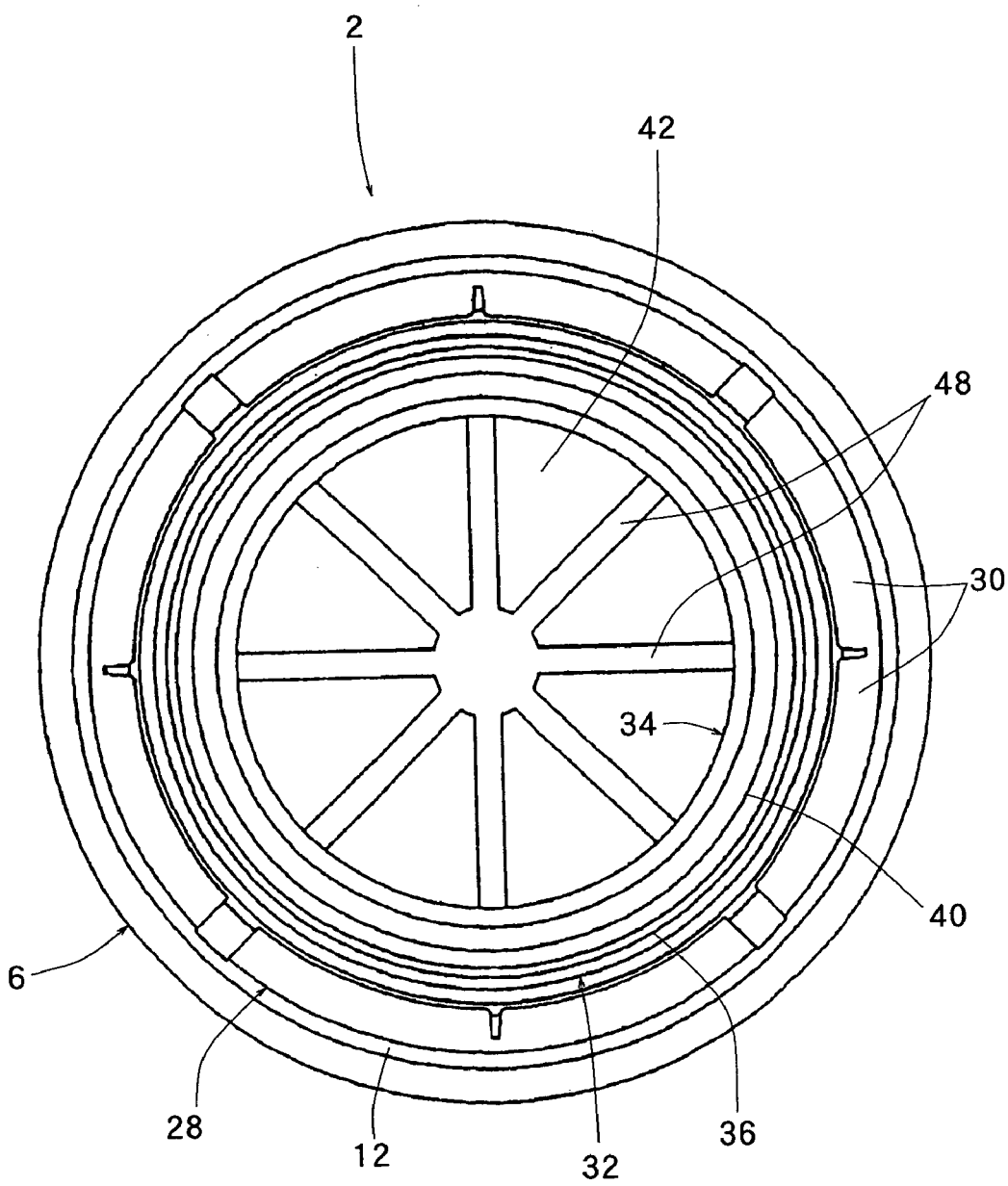
FIG. 3 is a bottom view of the container closure of FIG. 1.

With reference to FIG. 3 together with FIG. 1 and FIG. 2, in the above aspect of the present invention, it is important that a plurality of ribs 48 should be disposed on the inner surface of the center portion 42 of the top panel wall 4 whose thickness has been reduced to T1. In the illustrated embodiment, eight ribs 48 continuously extending radially from the center of the center portion 42 to the peripheral edge are formed at equiangular intervals. Each of the ribs 48 preferably has the same cross sectional form along the entire length, and in the illustrated embodiment the cross sectional form of the rib 48 is rectangular. It is important that the thickness T2 of each of the plurality of ribs 48 should be 0.20 to 1.00 mm, preferably 0.30 to 0.50 mm. It is also important that the total (T1+T2) of the thickness T1 of the center portion 42 of the top panel wall 4 and the thickness T2 of the rib 48 arranged on the center portion 42 should be 1.20 to 1.80 mm, particularly 1.30 to 1.50 mm. Further, when the area of the center portion 42 of the top panel wall 4 is represented by S1 and the total area of the ribs 48 is represented by S2 in a bottom view of FIG. 3, S1 and S2 satisfy preferably $0.10S1<S2<0.40S1$, particularly preferably $0.15S1<S2<0.35S1$. If the thickness T2 of the rib 48 or the total (T1+T2) of the thickness T1 of the center portion 42 and the thickness T2 of the rib 48 is too large, the required cooling time in the mold will become long and the molding efficiency will lower. If the thickness T2 of the rib 48 or the total (T1+T2) of the thickness T1 of the center portion 42 and the thickness T2 of the rib 48 is too small, the rigidity of the top panel wall 4 may become too low and the hermetical sealing of the mouth-neck portion of the container will may become insufficient. Further, the following problem arises in the printing step. That is, the trade name of a product, the name of a manufacture or distributor and the like are generally printed on the outer surface of the top panel wall 4 of the container closure 2 by offset printing. This offset printing is carried out by mounting the container closure 2 on a mandrel (not shown) so as to bring the inner surface of the center portion 42 of the top panel wall 4 into close contact with the top surface of the mandrel, and then applying an offset printing roller (not shown) formed from a material having elasticity, such as synthetic rubber, to the outer surface of the top panel wall 4 of the container closure 2 in a printing area. Even when the outer surface of the top panel wall 4 has some generally permissible distortion, it is important for carrying out fully satisfactory printing that the printing roller should be compressed by approximately 1 mm at the time when the printing roller is applied to the outer surface of the top panel wall 4 of the container closure 2. However, when the thickness T2 of the rib 48 or the total (T1+T2) of the thickness T1 of the center portion 42 and the thickness T2 of the rib 48 is too small, the space between the top surface of the mandrel in a state of the container closure 2 being not mounted and the peripheral surface of the printing roller must be set to zero or as a small value as possible because the thickness of the top panel wall 4, particularly the center portion, has been reduced to approximately 1 mm, for example. By setting the space as described above, if the mandrel is moved through the printing area without the container closure 2 being mounted thereon for some accidental reason, printing ink will be adhered to the top surface of the mandrel, and consequently when the subsequent container closure 2 is mounted on this mandrel, the inner surface of the center portion 42 of the top panel wall 4 of the subsequent container closure 2 will be stained by the printing ink.

FIG. 1 and FIG. 2 show part of the mouth-neck portion of the container, to which the container closure 2 is applied, by two-dot chain lines. The container which can be formed from an appropriate synthetic resin such as polyethylene terephthalate has a substantially cylindrical mouth-neck portion 50. It is preferred that the mouth-neck portion 50 be crystallized by heating after it is molded to a desired shape. On the outer peripheral surface of the mouth-neck portion 50 are formed a male thread 52 and an annular engaging jaw portion 54 (FIG. 1) which is located below the male thread 52. An upper end portion located above the male thread 52 has an annular top surface 56 extending substantially horizontally and a cylindrical outer peripheral surface 58 extending substantially vertically. The inner peripheral surface 62 of the mouth-neck portion 50 is cylindrical and extends substantially vertically. When the mouth-neck portion 50 is to be sealed hermetically by fitting the container closure 2 on the mouth-neck portion 50 of the container, the container closure 2 is mounted on the mouth-neck portion 50 and turned in a closing direction, that is, in a clockwise direction when viewed from above in FIG. 1 and FIG. 2, to screw the female thread 24 of the container closure 2 onto the male thread 52 of the mouth-neck portion 50. When the container closure 2 is turned in a closing direction with required torque to be set in a state shown in FIG. 1 and FIG. 2, the inner cylindrical sealing protrusion 34 is caused to advance into the mouth-neck portion 50 and the outer peripheral surface of the bent portion 40 of the inner cylindrical sealing protrusion 34 is brought into close contact with the cylindrical inner peripheral surface 62 of the mouth-neck portion 50. The annular sealing ridge 36 is brought into close contact with the annular top surface 56 of the mouth-neck portion 50, and the inner peripheral surface of the outer cylindrical sealing protrusion 32 is brought into close contact with the cylindrical outer peripheral surface 58 of the mouth-neck portion 50. Thus, the mouth-neck portion is sealed hermetically by the container closure 2. As is clearly understood with reference to FIG. 2, in the closure container constituted according to one aspect of the present invention, it is important that before the container closure 2 is mounted on the mouth portion 50 of the container, the above minimum internal diameter D1 of the outer cylindrical sealing protrusion 32 be smaller than the external diameter D2 of the outer peripheral surface of the mouth-neck portion 50 to be brought into close contact with the outer cylindrical sealing protrusion 32 and satisfy $0.05\ \text{mm} \leqq (D2-D1) < 0.60\ \text{mm}$ and that the above maximum internal diameter D3 of the inner cylindrical sealing protrusion 34 should be larger than the internal diameter D4 of the inner peripheral surface 62 of the mouth-neck portion 50 to be brought into contact with the inner cylindrical sealing protrusion 34 and satisfy $0.25 \leqq (D3-D4) \leqq 1.50$ mm. According to the experience of the inventors of the present invention, if (D2−D1) and (D3−D4) are too small, such tendency occurs that the hermetical sealing of the mouth-neck portion 50 may become unsatisfactory and at the same time, the sealing of the mouth-neck portion 50 may be released before the container closure 2 is turned at a required rotation angle to open the mouth-neck portion 50. On the other hand, if (D2−D1) and (D3−D4) are too large, there is a tendency that torque applied to the container closure 2 may become excessive at the time when the container closure 2 is to be mounted on the mouth-neck portion 50 or the container closure 2 is to be removed from the mouth-neck portion 50. The engaging means 28 formed on the tamper-evident skirt portion 12 of the container closure 2 elastically deforms outward in a radial direction, passes over the annular jaw portion 54 of the mouth-neck portion 50 and then elastically restores to the original form to be engaged with the under surface of the annular jaw portion 54.

To open the mouth-neck portion 50 of the container, the container closure 2 is turned in an opening direction, that is, in a counterclockwise direction when viewed from above in FIG. 1 and FIG. 2. At this occasion, though the upward movement of the tamper-evident skirt portion 12 is prevented as the engaging means 28 formed on the inner peripheral surface of the tamper-evident skirt portion 12 is engaged with the under surface of the annular jaw portion 54 formed on the outer peripheral surface of the mouth-neck portion 50, other portions of the container closure 2 are moved upward as the engagement between the male thread 52 and the female thread 24 is released by rotation. Consequently, great stress is generated in the breakable line 8 formed in the skirt wall 6, more specifically in the bridging portions 18, so that the bridging portions 18 are broken, and hence the tamper-evident skirt portion 12 is separated from the main portion 10 of the skirt wall 6. Thereafter, the portion other than the tamper-evident skirt portion 12 of the container closure 2 is moved upward freely with rotation and separated from the mouth-neck portion 50.

Figure 4:
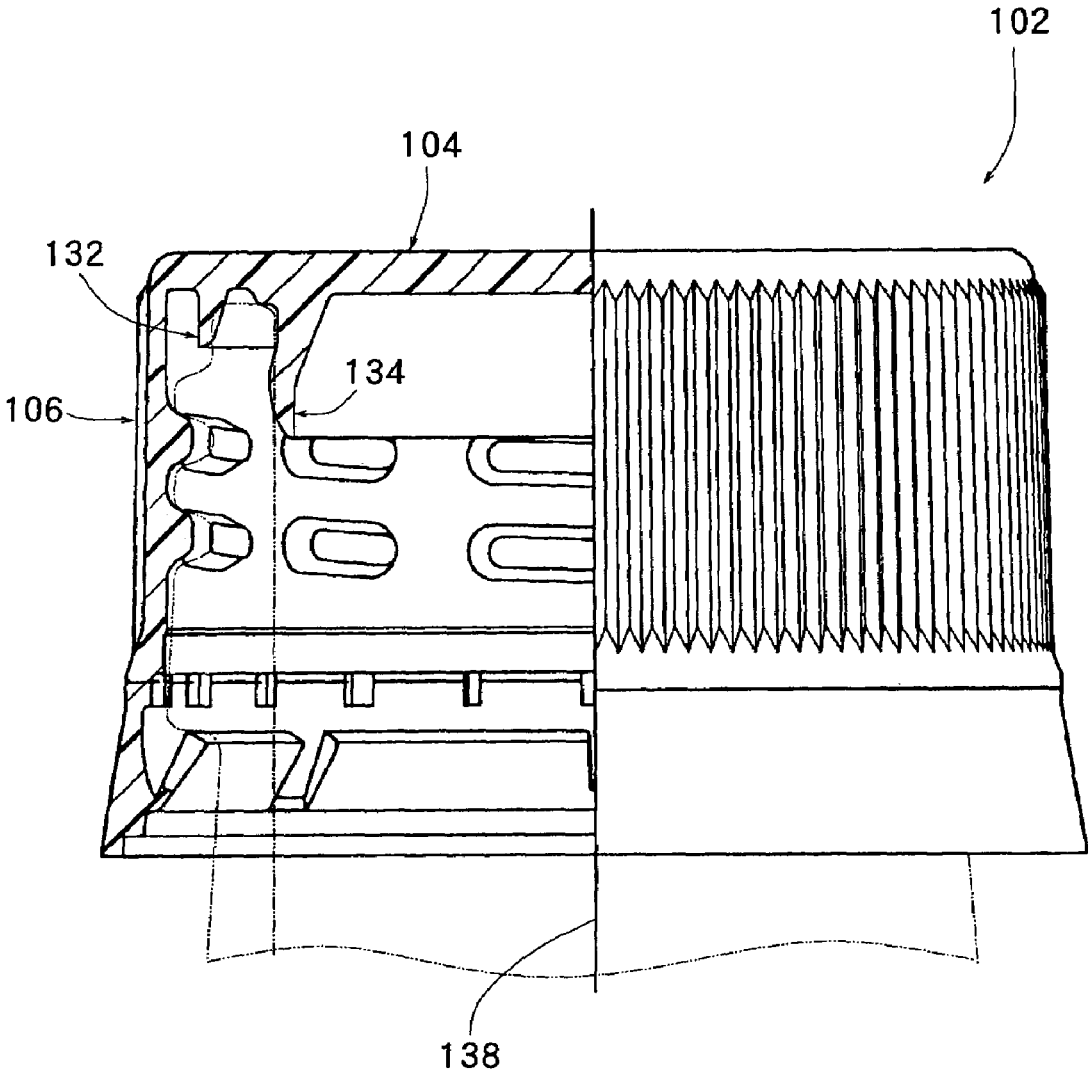
FIG. 4 is partially a side view and partially a sectional view of a container closure constituted according to another embodiment of the present invention.
Figure 5:
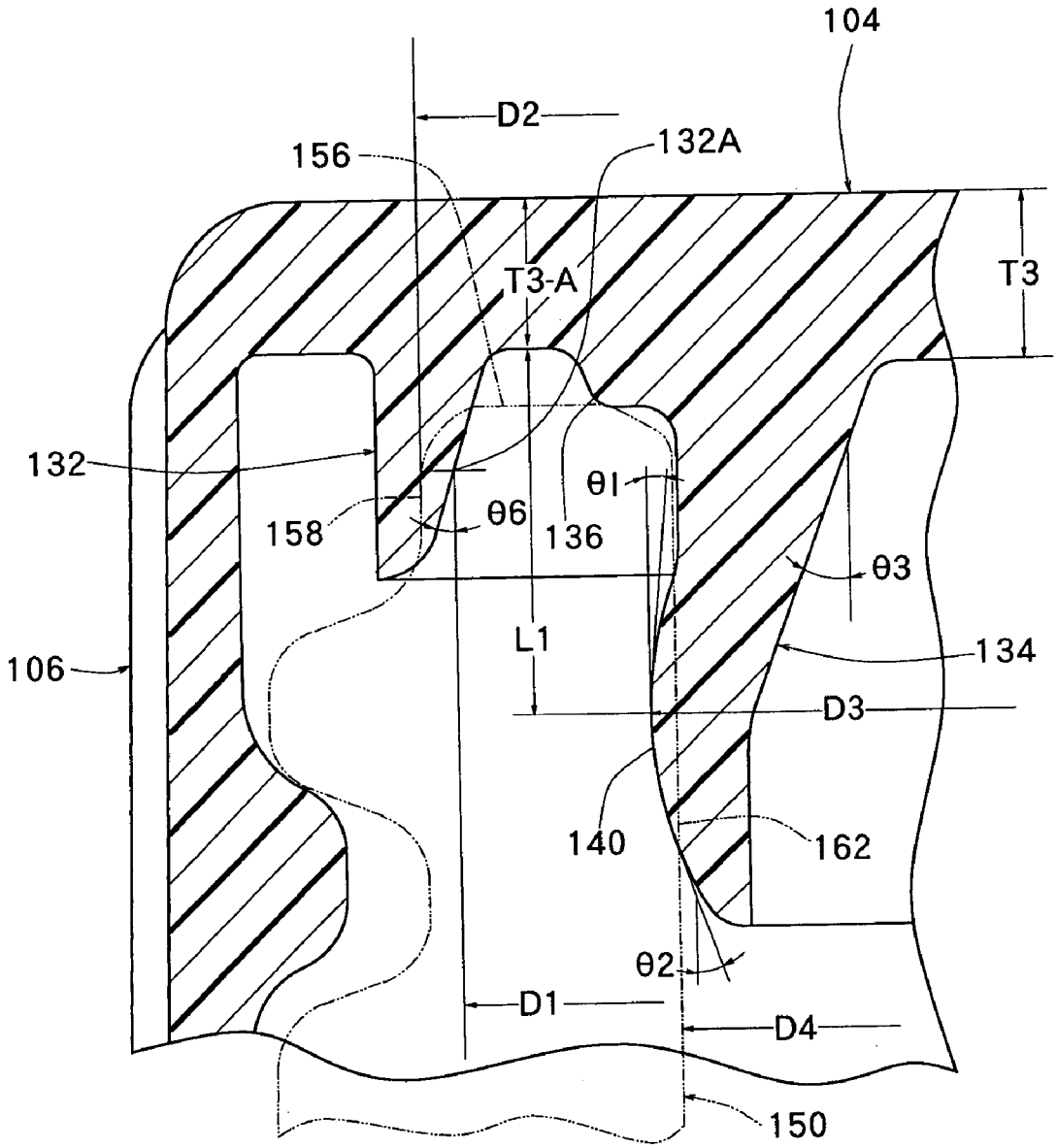
FIG. 5 is a sectional view, on an enlarged scale, of a part of the container closure of FIG. 4.

FIG. 4 and FIG. 5 show a synthetic resin container closure constituted according to another embodiment of the present invention. A container closure entirely denoted by numeral 102 is preferably applied to the mouth-neck portion of a container filled with contents having normal temperature in a germ-free or germ reduced state (i.e., a container to which aseptic filling-up is applicable). This container closure 102 also has a circular top panel wall 104 and a skirt wall 106 extending downwardly from the peripheral edge of the top panel wall 104. Also in the container closure 102, it is important that on the inner surface of the top panel wall 104 are formed an outer cylindrical sealing protrusion 132, inner cylindrical sealing protrusion 134 and annular sealing ridge 136 arranged between the outer cylindrical sealing protrusion 132 and the inner cylindrical sealing protrusion 134.

In the container closure 102 shown in FIG. 4 and FIG. 5, the center portion, that is, the portion on the inner side in a radial direction of the inner cylindrical sealing protrusion 134 of the top panel wall 104, has a relatively large thickness T3. (Therefore, in the container closure 104, the improvement according to the above aspect of the present invention that the center portion of the top panel wall 104 is made thin and a plurality of ribs are provided is not made. Making an additional remark on this point, the inner surface of the container closure 102 must be sterilized for aseptic filling. Therefore, the inner surface of the top panel wall 104 desirably does not have a shape change such as an uneven portion, but is as flat as possible, and the formation of a plurality of ribs on the inner surface of the top panel wall 104 should be avoided). The thickness T3-A of the top panel wall 104 at a portion which is located on the outer side in a radial direction of the annular sealing ridge 136 formed adjacently to the base portion of the outer peripheral surface of the inner cylindrical sealing protrusion 134 is slightly smaller than the above thickness T3. The thickness T3 may be 1.10 to 1.80 mm and the thickness T3-A may be 0.90 to 1.70 mm.

With further reference to FIG. 4 and FIG. 5, the inner cylindrical sealing protrusion 134 of the container closure 102 is substantially identical to the inner cylindrical sealing protrusion 34 in the above-mentioned container closure 2 and extends downwardly from the inner surface of the top panel wall 104. The outer peripheral surface of the inner cylindrical sealing protrusion 134 extends downwardly from the inner surface of the top panel wall 104 substantially parallel with the center axis 138 (FIG. 4) of the closure container 102 over some length and then, extends downwardly in such a manner that it is inclined outward (left direction in FIG. 5) in a radial direction at an inclination angle θ1 with respect to the above center axis 138 and then, extends downwardly in such a manner that it is inclined inward (right direction in FIG. 5) in a radial direction at an inclination angle θ2 with respect to the above center axis 138. Therefore, a bent portion 140 where the inclination direction is changed is existent on the outer peripheral surface of the inner cylindrical sealing protrusion 134. The above inclination angle θ1 is suitably approximately 5 to 25° and the above inclination angle θ2 is suitably approximately 5 to 30°. In the sectional view of FIG. 5, an upper end portion of the outer peripheral surface of the inner cylindrical sealing protrusion 134 extends substantially linearly, and the main portion including the bent portion 140 is convex with a relatively large curvature radius (the inclination angles θ1 and θ2 of the convex portion are formed by a tangent at each site and the above center axis 138) and a lower end portion extends nearly in an arc form. Since the outer peripheral surface of the inner cylindrical sealing protrusion 134 is shaped as described above, the inner cylindrical sealing protrusion 134 has the maximum external diameter D3 at the bent portion 140. As is understood with reference to FIG. 5, the bent portion 140 of the inner cylindrical sealing protrusion 134 is brought into close contact with the inner peripheral surface 162 of the mouth-neck portion 150 of the container, and the above maximum external diameter D3 is therefore the maximum external diameter of the portion to be brought into close contact with the mouth-neck portion 150 of the container, of the inner cylindrical sealing protrusion 134. The portion having the maximum external diameter D3 is suitably located below and away from the inner surface of the top panel wall 104 by a length L1 of 2.50 to 3.50 mm.

The inner peripheral surface of the inner cylindrical sealing protrusion 134 extends downwardly in such a manner that it is inclined outward in a radial direction at an inclination angle θ3 with respect to the above center axis 138, and then, extends substantially parallel with the above center axis 138. The inclination angle θ3 may be approximately 7 to 30°. Since the outer peripheral surface and inner peripheral surface of the inner cylindrical sealing protrusion 134 are formed as described above, as is clearly understood with reference to FIG. 5, the thickness of the inner cylindrical sealing protrusion 134 is gradually decreased downward.

The outer cylindrical sealing protrusion 132 of the container closure 102 also extends downwardly from the inner surface of the top panel wall 104. The length of extension of the outer cylindrical sealing protrusion 132 is smaller than the length of extension of the inner cylindrical sealing protrusion 134 and is approximately ⅓ the length of extension of the inner cylindrical sealing protrusion 134. In the case of an aseptic filling-applicable container, the dimensional accuracy of the mouth-neck portion is relatively high because it is not necessary to crystallize the mouth-neck portion by heating after the container is molded to a desired shape. Therefore, according to the experience of the inventors of the present invention, hermetical sealing by the inner cylindrical sealing protrusion 134 fully satisfies requirements for the hermetical sealing of the mouth-neck portion basically. The outer cylindrical sealing protrusion 132 contributes to the positioning of the container closure 102 when the container closure 102 is mounted on the mouth-neck portion or the prevention of entry of germs from the outside. From this point of view, the inner peripheral surface of the outer cylindrical sealing protrusion 132 extends linearly in such a manner that it is inclined outward in a radial direction at an inclination angle θ6 with respect to the above center axis 138 and then, extends downwardly and radially outwardly in an arc form. The above inclination angle θ6 may be approximately 10 to 25°. As is understood with reference to FIG. 5, when the container closure 102 is mounted on the mouth-neck portion 150 of the container as required, the annular sealing ridge 136 is brought into contact with the top surface 156 of the mouth-neck portion 150, and a portion below a portion denoted by 132A of the outer cylindrical sealing protrusion 132 is brought into close contact with the outer peripheral surface 158 of the mouth-neck portion 150. Therefore, the internal diameter of the portion denoted by 132A of the inner peripheral surface of the outer cylindrical sealing protrusion 132 is the minimum internal diameter D1 of the portion to be brought into close contact with the outer peripheral surface 158 of the mouth-neck portion 150. The outer peripheral surface of the outer cylindrical sealing protrusion 132 extends substantially parallel with the above center axis 138.

Also in the container closure 102 shown in FIG. 4 and FIG. 5, like the container closure 2 shown in FIGS. 1 to 3, it is desired that in a state before the container closure 102 is mounted on the mouth-neck portion 150 of the container, the above minimum internal diameter D1 of the outer cylindrical sealing protrusion 132 should be smaller than the external diameter D2 of the outer peripheral surface 158 to be brought into close contact with the outer cylindrical sealing protrusion 132 of the mouth-neck portion 150 and satisfy 0.05 mm≦(D2−D1)≦0.60 mm and that the above maximum external diameter D3 of the inner cylindrical sealing protrusion 134 should be larger than the internal diameter D4 of the inner peripheral surface 162, that is to be brought into close contact with the inner cylindrical sealing protrusion 134 of the mouth-neck portion 150 and satisfy 0.25 mm≦(D3−D4)≦1.50 mm.

The annular sealing ridge 136 is formed adjacently to the base portion of the outer peripheral surface of the inner cylindrical sealing protrusion 134 and nearly rectangular as a whole, and the lower end portion of the inner peripheral surface thereof has a circular arc cross sectional form with a small curvature radius. The amount of projection of the annular sealing ridge 136 is much smaller than the length of extension of the inner cylindrical sealing protrusion 134 and the length of extension of the outer cylindrical sealing protrusion 132, and the inner cylindrical sealing protrusion 134 and the outer cylindrical sealing protrusion 132 have relatively high flexibility such that they bend inward and outward in a radial direction, while the annular sealing ridge 136 has substantially no flexibility.

The container closure 102 shown in FIG. 4 and FIG. 5 is substantially identical to the container closure 2 shown in FIGS. 1 to 3 except the above constitution. A description of the constitution other than the above constitution of the container closure 102 is omitted.

In the above-described container closure 2 (102), when the mouth-neck portion 50 (150) is opened, all the bridging portions 18 on the breakable line 8 formed in the skirt wall 6 (106) of the container closure 2 (102) are broken, and the tamper-evident skirt portion 12 is completely separated from the main portion 10 of the skirt wall 6 (106) and caused to remain on the mouth-neck portion 50 (150) without being separated from the mouth-neck portion 50 (150). If desired, at least one of the bridging portions 18 on the breakable line 8 may be made a strong bridging portion which can be unbroken and kept, and a breakable line (not shown) extending in an axial direction may be formed in the tamper-evident skirt portion 12 so that when the mouth-neck portion 50 (150) is opened, the breakable line extending in an axial direction is broken to make the tamper-evident skirt portion 12 from an endless ring form into a belt form, and the tamper-evident skirt portion 12 that is kept connected to the main portion 10 of the skirt wall 6 (106) through the strong bridging portion which is unbroken and kept is also separated from the mouth-neck portion 50 (150).

EXAMPLE 1

A container closure having a shape shown in FIGS. 1 to 3 was formed from an ethylene-propylene copolymer (melt flow index at 230° C. and 2,160 g of 20 g/10 min. and flexural modulus of 1,700 MPa) as a raw material by compression molding. The molded container closure was for a container having a mouth-neck portion with a nominal diameter of 28 mm and its major sizes were as follows.

| | | | |
|---|---|---|---|
| D1 | 24.70 mm | D3 | 20.90 mm |
| T1 | 1.00 mm | T2 | 0.40 mm |
| T1-A | 1.30 mm | | |
| T2-B | 1.60 mm | | |

A polyethylene terephthalate container having a mouth-neck portion with a nominal diameter of 28 mm and a nominal volume of 500 ml marketed under the trade name of "TSK Kuki STHE 500 Natural G" from Toyo Seikan Co., Ltd. was filled with water heated at 87° C., and the above container closure was mounted on the mouth-neck portion by applying a torque of 21 kgfcm. The container was laid horizontally for 39 seconds, returned to an upright position, and sprayed with water heated at 75° C. for 3 minutes, water heated at 50° C. for 15 minutes and water heated at 30° C. for 15 minutes. Thereafter, the container closure was left at 50° C. for 5 days.

The external diameter D2 of the mouth-neck portion of the above container was 24.94 mm and the internal diameter D4 thereof was 20.60 mm. Therefore, (D2−D1) was 0.24 mm and (D3−D4) was 0.30 mm.

Thereafter, the container closure was turned in an opening direction and removed from the mouth-neck portion of the container. The initial torque (torque that was required for starting the rotation of the container closure), the rotation angle (angle B) of the container closure before the breakable line began to be broken, and the rotation angle (angle L) of the container closure before the sealing of the mouth-neck portion was released were measured. The rotation of the container closure was carried out by placing the container inverted and the release of sealing was judged from entry of air into the container (air bubbles entered water in the container). The results of 10 container closures are shown in Table 1 below. The angle B is desired to be smaller than the angle L and hence, when the angle B is larger than the angle L, it is judged as improper BL. The initial torque is desired to be 20 kgfcm or less and hence, when the initial torque is larger than 20 kgfcm, it is judged as improper torque.

EXAMPLE 2

The initial torque and the angles B and L were measured in the same manner as in Example 1 except that D3 of the container closure was 21.41 mm and (D3−D4) was 0.81 mm. The results are shown in Table 2.

EXAMPLE 3

The initial torque and the angles B and L were measured in the same manner as in Example 1 except that D3 of the container closure was 22.00 mm and (D3−D4) was 1.40 mm. The results are shown in Table 3.

COMPARATIVE EXAMPLE 1

The initial torque and the angles B and L were measured in the same manner as in Example 1 except that D3 of the container closure was 20.80 mm and (D3–D4) was 0.20 mm. The results are shown in Table 4.

COMPARATIVE EXAMPLE 2

The initial torque and the angles B and L were measured in the same manner as in Example 1 except that D3 of the container closure was 22.15 mm and (D3–D4) was 1.55 mm. The results are shown in Table 5.

EXAMPLE 4

The angles B and L were measured in the same manner as in Example 1 except that D1 of the container closure was 24.84 mm and (D2–D1) was 0.10 mm. The results are shown in Table 6.

EXAMPLE 5

The angles B and L were measured in the same manner as in Example 1 except that D1 of the container closure was 24.70 mm and (D2–D1) was 0.24 mm. The results are shown in Table 6.

COMPARATIVE EXAMPLE 3

The angles B and L were measured in the same manner as in Example 1 except that D1 of the container closure was 24.92 mm and (D2–D1) was 0 mm. The results are shown in Table 6.

TABLE 1

Example 1: D3 - D4 = 0.30 mm

| | Initial torque (kgfcm) | Angle L | Angle B | L - B |
|---|---|---|---|---|
| No.1 | 12.5 | 270 | 215 | 55 |
| No.2 | 15.1 | 230 | 215 | 15 |
| No.3 | 13.7 | 245 | 230 | 15 |
| No.4 | 14.3 | 250 | 200 | 50 |
| No.5 | 12.9 | 250 | 215 | 35 |
| No.6 | 14.8 | 235 | 220 | 15 |
| No.7 | 14.5 | 230 | 210 | 20 |
| No.8 | 14.1 | 235 | 210 | 25 |
| No.9 | 13.8 | 245 | 215 | 30 |
| No.10 | 13.6 | 260 | 220 | 40 |
| Average | 13.93 | 245.0 | 215.0 | 30.0 |
| Maximum | 15.1 | 270 | 230 | 55 |
| Minimum | 12.5 | 230 | 200 | 15 |
| Improper torque | | 0/10 | | |
| Improper BL | | 0/10 | | |

TABLE 2

Example 2: D3 - D4 = 0.81 mm

| | Initial torque (kgfcm) | Angle L | Angle B | L - B |
|---|---|---|---|---|
| No.1 | 15.7 | 290 | 210 | 80 |
| No.2 | 16.4 | 305 | 220 | 85 |
| No.3 | 16.9 | 290 | 205 | 85 |
| No.4 | 14.4 | 280 | 215 | 65 |
| No.5 | 16.0 | 265 | 205 | 60 |

TABLE 2-continued

Example 2: D3 - D4 = 0.81 mm

| | Initial torque (kgfcm) | Angle L | Angle B | L - B |
|---|---|---|---|---|
| No.6 | 14.3 | 290 | 225 | 65 |
| No.7 | 15.7 | 245 | 210 | 35 |
| No.8 | 15.1 | 260 | 210 | 50 |
| No.9 | 15.4 | 290 | 210 | 80 |
| No.10 | 15.5 | 300 | 245 | 55 |
| Average | 15.54 | 281.5 | 215.5 | 66.0 |
| Maximum | 16.9 | 305 | 245 | 85 |
| Minimum | 14.3 | 245 | 205 | 35 |
| Improper torque | | 0/10 | | |
| Improper BL | | 0/10 | | |

TABLE 3

Example 3: D3 - D4 = 1.40 mm

| | Initial torque (kgfcm) | Angle L | Angle B | L - B |
|---|---|---|---|---|
| No.1 | 18.2 | 300 | 210 | 90 |
| No.2 | 17.9 | 305 | 240 | 65 |
| No.3 | 19.1 | 295 | 215 | 80 |
| No.4 | 17.5 | 295 | 220 | 75 |
| No.5 | 18.0 | 280 | 195 | 85 |
| No.6 | 18.2 | 295 | 240 | 55 |
| No.7 | 16.8 | 290 | 230 | 60 |
| No.8 | 17.0 | 305 | 230 | 75 |
| No.9 | 18.9 | 285 | 200 | 86 |
| No.10 | 17.3 | 270 | 205 | 65 |
| Average | 17.89 | 292.0 | 218.5 | 73.5 |
| Maximum | 19.1 | 305 | 240 | 90 |
| Minimum | 16.8 | 270 | 195 | 55 |
| Improper torque | | 0/10 | | |
| Improper BL | | 0/10 | | |

TABLE 4

Comparative Example 1: D3 - D4 = 0.20 mm

| | Initial torque (kgfcm) | Angle L | Angle B | L - B |
|---|---|---|---|---|
| No.1 | 11.9 | 250 | 210 | 40 |
| No.2 | 14.5 | 230 | 210 | 20 |
| No.3 | 15.0 | 245 | 205 | 40 |
| No.4 | 13.4 | 230 | 230 | 0 |
| No.5 | 12.6 | 230 | 210 | 20 |
| No.6 | 13.9 | 250 | 225 | 25 |
| No.7 | 14.5 | 225 | 240 | −15 |
| No.8 | 14.2 | 235 | 235 | 0 |
| No.9 | 14.1 | 230 | 200 | 30 |
| No.10 | 12.4 | 245 | 205 | 40 |
| Average | 13.66 | 241.5 | 217.5 | 24.5 |
| Maximum | 15.0 | 255 | 240 | 40 |
| Minimum | 11.9 | 225 | 200 | −15 |
| Improper torque | | 0/10 | | |
| Improper BL | | 1/10 | | |

TABLE 5

| | Comparative Example 2: D3 - D4 = 1.55 mm | | | |
|---|---|---|---|---|
| | Initial torque (kgfcm) | Angle L | Angle B | L - B |
| No.1 | 18.5 | 310 | 205 | 105 |
| No.2 | 17.8 | 305 | 215 | 90 |
| No.3 | 18.4 | 320 | 245 | 75 |
| No.4 | 19.7 | 290 | 205 | 85 |
| No.5 | 21.1 | 295 | 200 | 95 |
| No.6 | 19.1 | 295 | 220 | 75 |
| No.7 | 18.7 | 285 | 215 | 70 |
| No.8 | 19.3 | 310 | 240 | 70 |
| No.9 | 19.6 | 300 | 210 | 90 |
| No.10 | 19.7 | 300 | 210 | 90 |
| Average | 19.19 | 301.0 | 216.5 | 84.5 |
| Maximum | 21.2 | 320 | 245 | 105 |
| Minimum | 17.8 | 285 | 200 | 70 |
| Improper torque | | 1/10 | | |
| Improper BL | | 0/10 | | |

TABLE 6

| | Comparative Example 3 0 mm | | | Example 4 0.1 mm | | | Example 5 0.24 mm | | |
|---|---|---|---|---|---|---|---|---|---|
| D2-D1 | Angle L | Angle B | L-B | Angle L | Angle B | L-B | Angle L | Angle B | L-B |
| No.1 | 240 | 225 | 15 | 260 | 210 | 50 | 315 | 200 | 115 |
| No.2 | 250 | 250 | 0 | 270 | 230 | 40 | 290 | 185 | 105 |
| No.3 | 275 | 230 | 45 | 285 | 240 | 45 | 280 | 210 | 70 |
| No.4 | 60 | 215 | −155 | 280 | 240 | 40 | 275 | 210 | 65 |
| No.5 | 310 | 220 | 90 | 280 | 225 | 55 | 300 | 210 | 90 |
| Average | 227.0 | 228.0 | −5.0 | 275.0 | 229.0 | 46.0 | 292.0 | 203.0 | 89.0 |
| Maximum | 310 | 250 | 90 | 285 | 240 | 55 | 315 | 210 | 115 |
| Minimum | 60 | 215 | −150 | 260 | 210 | 40 | 275 | 185 | 65 |
| Improper BL | | 1/5 | | | 0/5 | | | 0/5 | |

What is claimed is:

1. A synthetic resin container closure for closing a container having a mouth-neck portion with an internal diameter D4, said container closure comprising:

a circular top panel wall;

a cylindrical skirt wall extending downwardly from the peripheral edge of the top panel wall and formed from a synthetic resin as a single unit with the top panel wall;

an outer cylindrical sealing protrusion extending downwardly from the inner surface of the top panel wall;

an inner cylindrical sealing protrusion extending downwardly from the inner surface of the top panel wall and having a maximum external diameter D3; and an annular sealing ridge located between the outer cylindrical sealing protrusion and the inner cylindrical sealing protrusion and projecting downwardly from the inner surface of the top panel wall, wherein:

0.25 mm≦(D3−D4)≦1.50 mm, so that when the container closure is mounted on the mouth-neck portion of the container, the inner peripheral surface of the outer cylindrical sealing protrusion is in close contact with the outer peripheral surface of the mouth-neck portion, the outer peripheral surface of the inner cylindrical sealing protrusion is in close contact with the inner peripheral surface of the mouth-neck portion, and the annular sealing ridge is in close contact with the top surface of the mouth-neck portion;

the inner peripheral surface of the outer cylindrical sealing protrusion extends downwardly with an outward inclination at an angle θ6 with respect to the center axis of the container closure and then extends downwardly and radially outwardly in an arc form;

the outer peripheral surface of the inner cylindrical sealing protrusion extends downwardly with an outward inclination at an angle θ1 with respect to the center axis of the container closure and then extends downwardly with an inward inclination at an angle θ2 with respect to the center axis;

the inclination angle θ1 is 5° to 25° and the inclination angle θ2 is 5° to 30°;

the inner peripheral surface of the inner cylindrical sealing protrusion extends downwardly with an outward inclination at an angle θ3 with respect to the center axis, and then extends substantially parallel with the center axis;

the inclination angle θ3 of the inner peripheral surface of the inner cylindrical scaling protrusion is larger than the inclination angle θ1 of the outer peripheral surface of the inner cylindrical sealing protrusion at a position above the position having the maximum external diameter D3; and the thickness of the inner cylindrical sealing protrusion gradually decreases as the inner cylindrical sealing protrusion extends downwardly from the inner surface of the top panel wall.

2. The container closure of claim 1, wherein the outer peripheral surface of the outer cylindrical sealing protrusion extends substantially parallel with the center axis.

3. The container closure of claim 1, wherein the outer peripheral surface of the inner cylindrical sealing protrusion has the maximum external diameter D3 at a position spaced from the inner surface of the top panel wall by a length L1 of 2.50 mm to 3.50 mm.

4. The container closure of claim 1, wherein 10°≦θ6≦25°.

5. The container closure of claim 1, wherein the inner surface of the top panel wall is devoid of ribs.

* * * * *